US011657949B2

(12) United States Patent
Tonoyama et al.

(10) Patent No.: US 11,657,949 B2
(45) Date of Patent: May 23, 2023

(54) MAGNETIC CORE AND COIL COMPONENT

(71) Applicant: TDK CORPORATION, Tokyo (JP)

(72) Inventors: Kyohei Tonoyama, Tokyo (JP); Ken Satoh, Tokyo (JP); Kentaro Saito, Tokyo (JP); Miyuki Asai, Tokyo (JP); Hitoshi Ohkubo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 838 days.

(21) Appl. No.: 16/663,464

(22) Filed: Oct. 25, 2019

(65) Prior Publication Data

US 2020/0135380 A1 Apr. 30, 2020

(30) Foreign Application Priority Data

Oct. 31, 2018 (JP) ..... JP2018-205396

(51) Int. Cl.

| | |
|---|---|
| ***H01F 27/28*** | (2006.01) |
| ***H01F 27/255*** | (2006.01) |
| ***H01F 17/00*** | (2006.01) |
| ***H01F 17/04*** | (2006.01) |
| ***H01F 27/29*** | (2006.01) |
| ***H01F 27/32*** | (2006.01) |

(52) U.S. Cl.

CPC ..... *H01F 27/255* (2013.01); *H01F 17/0013* (2013.01); *H01F 17/04* (2013.01); *H01F 27/2804* (2013.01); *H01F 27/292* (2013.01); *H01F 27/324* (2013.01); *H01F 2017/048* (2013.01); *H01F 2027/2809* (2013.01)

(58) Field of Classification Search

USPC ..... 336/83, 200, 232, 192

See application file for complete search history.

(56) References Cited

U.S. PATENT DOCUMENTS

| | | | | |
|---|---|---|---|---|
| 2014/0077914 | A1* | 3/2014 | Ohkubo | H01F 5/00 75/255 |
| 2016/0155550 | A1* | 6/2016 | Ohkubo | H01F 1/24 336/233 |
| 2017/0154720 | A1* | 6/2017 | Ohkubo | H01F 27/292 |

(Continued)

FOREIGN PATENT DOCUMENTS

| | | | |
|---|---|---|---|
| CN | 107170575 | A | 9/2017 |
| JP | 2007-270271 | A | 10/2007 |

(Continued)

*Primary Examiner* — Shawki S Ismail
*Assistant Examiner* — Kazi S Hossain
(74) *Attorney, Agent, or Firm* — Oliff PLC

(57) ABSTRACT

A magnetic core and a coil component with excellent permeability, core loss, DC superimposition property, and withstand voltage. A magnetic core has a metal magnetic powder containing resin including a metal magnetic powder. The metal magnetic powder includes a large size powder, an intermediate size powder, and a small size powder. A particle size of the large size powder is 10 μm or more and 60 μm or less. A particle size of the intermediate size powder is 2.0 μm or more and less than 10 μm. A particle size of the small size powder is 0.1 μm or more and less than 2.0 μm. The large size powder includes a nano crystal. A ratio of the large size powder existing with respect to the metal magnetic powder is 39% or more and 91% or less in terms of an area ratio in a cross section of the magnetic core.

12 Claims, 7 Drawing Sheets

(56) References Cited

U.S. PATENT DOCUMENTS

| | | | | |
|---|---|---|---|---|
| 2018/0218813 | A1 | 8/2018 | Harada et al. | |
| 2021/0313101 | A1* | 10/2021 | Yamamoto | B22F 1/052 |

FOREIGN PATENT DOCUMENTS

| | | | |
|---|---|---|---|
| JP | 2012-012699 | A | 1/2012 |
| JP | 2016-025352 | A | 2/2016 |
| JP | 2017-103287 | A | 6/2017 |
| JP | 2018-123361 | A | 8/2018 |

* cited by examiner

MAGNETIC CORE AND COIL COMPONENT

BACKGROUND OF THE INVENTION

The present invention relates to a magnetic core and a coil component.

In the field of electronic devices, a surface-mounting type coil component is widely used as a power inductor. As one of the specific structures of the surface-mounting type coil component, a flat coil structure is known which uses a print circuit board technology.

Patent document 1 proposes a coil component having a magnetic core produced using two or more metal magnetic powders having different particle sizes. By using two or more metal magnetic powders having different particle sizes, it is known to have effect to improve a permeability and to lower a core loss.

Patent document 1: 2017-103287

BRIEF SUMMARY OF THE INVENTION

Recently, a magnetic core having even better properties is demanded. The present invention is attained in view of such circumstances and the object is to provide a magnetic core and a coil component having excellent permeability, core loss, DC superimposition property, and withstand voltage.

In order to attain the above object, the magnetic core according to the present invention includes a metal magnetic powder, in which the metal magnetic powder includes a large size powder, an intermediate size powder, and a small size powder, a particle size of the large size powder is 10 μm or more and 60 μm or less, a particle size of the intermediate size powder is 2.0 μm or more and less than 10 μm, a particle size of the small size powder is 0.1 μm or more and less than 2.0 μm, the large size powder includes a nano crystal, and a ratio of the large size powder existing with respect to the metal magnetic powder is 39% or more and 91% or less in terms of an area ratio in a cross section of the magnetic core.

By constituting the magnetic core according to the present invention as described in above, a magnetic core having excellent permeability, core loss, DC superimposition property, and withstand voltage can be obtained.

The intermediate size powder may include a nano crystal.

The small size powder may include a permalloy.

The nano crystal may include a Fe-based nano crystal.

The Fe-based nano crystal may include Fe and M, and

M may be one or more selected from the group consisting of Nb, Hf, Zr, Ta, Mo, W, and V.

The metal magnetic powder may have an insulation coating.

An average thickness of the insulation coating may be 5 nm to 45 nm.

A ratio of the intermediate size powder existing with respect to a ratio of the small size powder may be 0.73 or more and 5.7 or less in terms of an area ratio in a cross section of the magnetic core.

As a metal magnetic powder, a metal magnetic powder including the nano crystal and a metal magnetic powder which does not include the nano crystal can be included at the same time; and a ratio of the metal magnetic powder including the nano crystal with respect to the entire magnetic metal powder is 40 wt % to 90 wt % in terms of a weight ratio.

The coil component according to the present invention includes the above mentioned magnetic core and a coil.

DETAILED DESCRIPTION OF THE INVENTION

Hereinafter, the present invention is described based on the embodiments shown in the figures.

Figure 1:
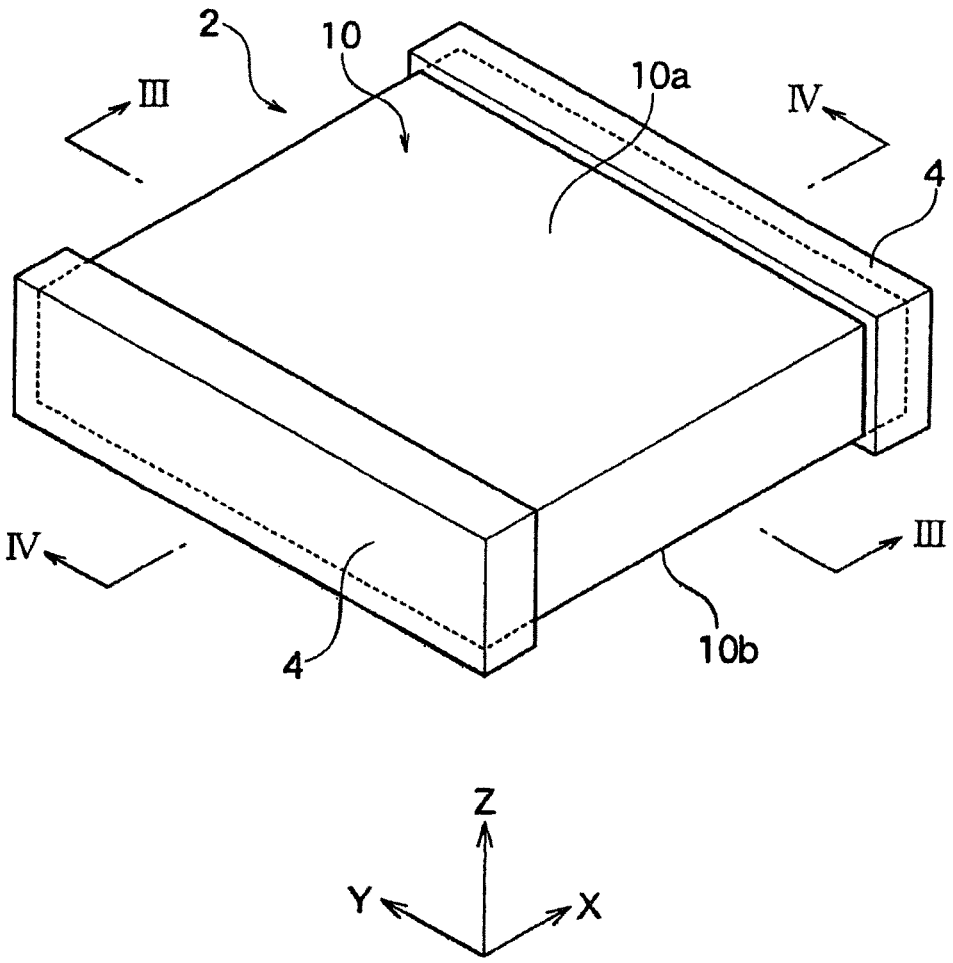
FIG. 1 is a perspective diagram of a coil component according to one embodiment of the present invention.

As one embodiment of a coil component according to the present invention, a coil component 2 shown in FIG. 1 to FIG. 4 may be mentioned. As shown in FIG. 1, the coil component 2 has a magnetic core 10 having a rectangular flat board shape and a pair of terminal electrodes 4, 4 provided to both ends in X-axis direction of the magnetic core 10. The terminal electrodes 4, 4 cover an end surface in X-axis direction of the magnetic core 10 and also partially cover an upper face 10*a* and a lower face 10*b* in Z-axis direction of the magnetic core 10 near the end surface in X-axis direction of the magnetic core 10. Further, the terminal electrodes 4, 4 partially cover a pair of side faces in Y-axis direction of the magnetic core 10.

Figure 2:
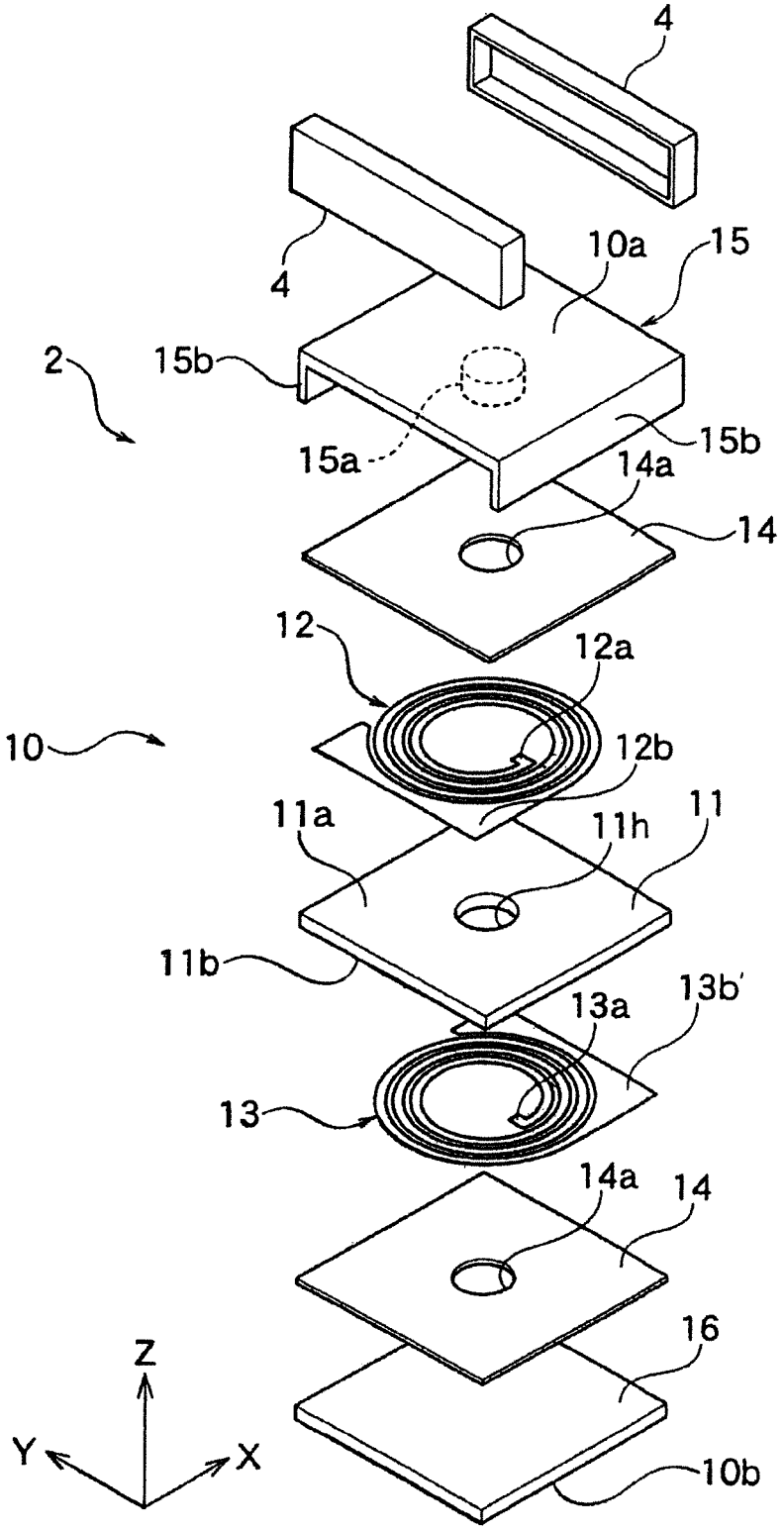
FIG. 2 is an exploded perspective diagram of the coil component shown in FIG. 1.

As shown in FIG. 2, the magnetic core 10 has an upper core 15 and a lower core 16; and also has an insulation board 11 at a center part of the magnetic core in Z-axis direction.

The insulation board 11 is preferably made of a generally available print board material in which a glass fabric is impregnated with epoxy resin; but it is not particularly limited.

Also, in the present embodiment, the shape of the resin board 11 is rectangular shape, but it may be any other shape. A method of forming the resin board 11 is not particularly limited, and for example it may be formed by an injection molding, a doctor blade method, a screen printing, and the like.

Also, at the upper face (one of the main surfaces) of the insulation board 11 in Z-axis direction, an internal electrode pattern is formed made of an inner conductor path 12 having a circular spiral shape. The inner conductor path 12 becomes a coil at the end. Also, a material of the inner conductor path 12 is not particularly limited.

At an inner end of the inner conductor path 12 of a spiral form, a connecting end 12*a* is formed. Also, at an outer end of the inner conductor path 12 of a spiral form, a lead contact 12*b* is formed so that it is exposed at one end along X-axis direction of the magnetic core 10.

At the lower face (the other main surface) of the insulation board 11 in Z-axis direction, the internal electrode pattern is formed which is made of inner conductor path 13 of a spiral form. The internal conductor path 13 becomes a coil at the end. Also, a material of the inner conductor path 13 is not particularly limited.

At an inner end of the inner conductor path 13 of a spiral form, a connecting end 13*a* is formed. Also, at an outer end of the inner conductor path 13 of a spiral form, a lead contact 13*b* is formed so that it is exposed at one end along X-axis direction of the magnetic core 10.

Figure 3:
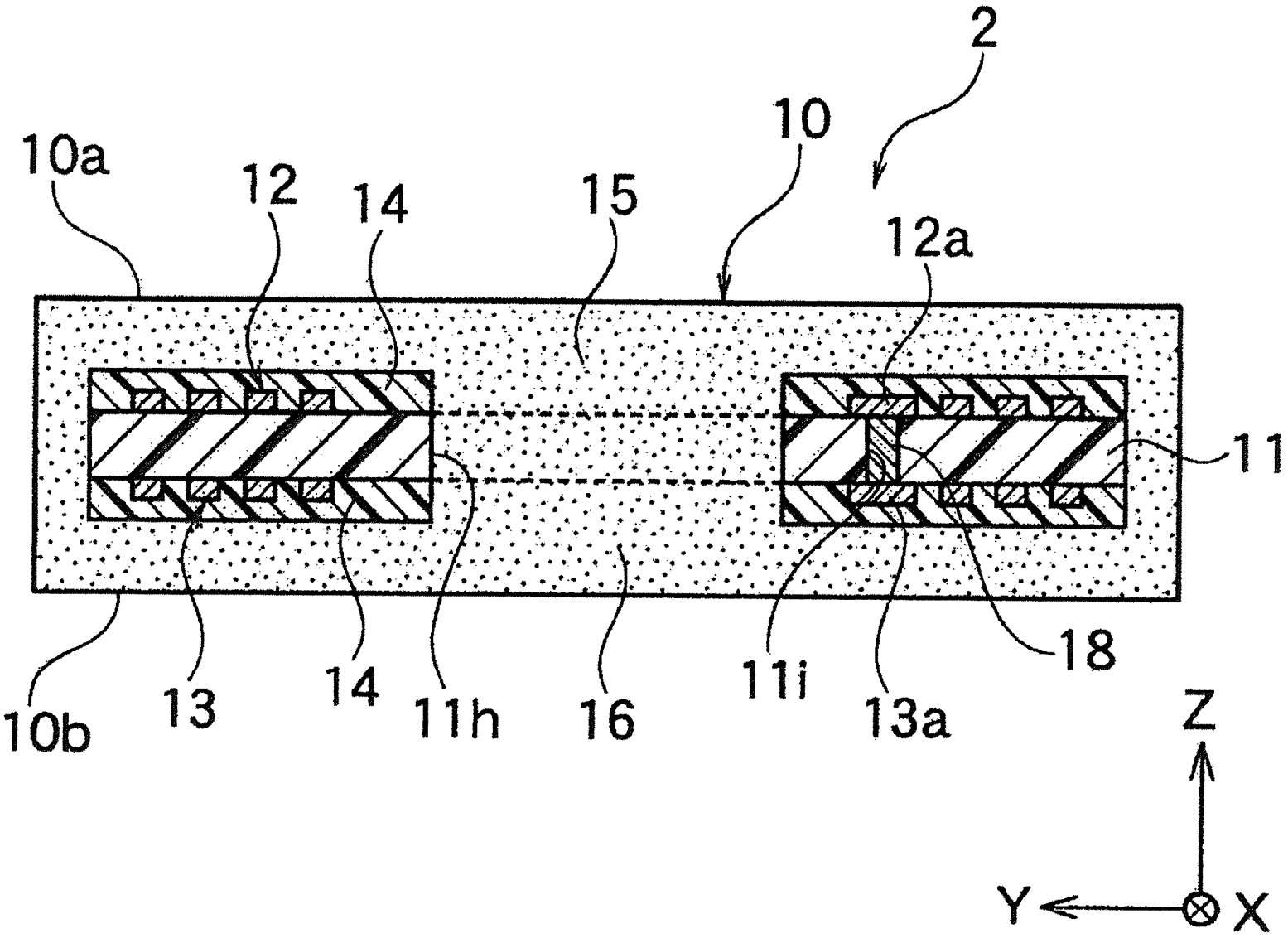
FIG. 3 is a cross section along line shown in FIG. 1.

As shown in FIG. 3, the connecting end 12*a* and the connecting end 13*a* are formed on the opposite side in Z-axis direction across the insulation board 11; and the connecting end 12*a* and the connecting end 13*a* are formed at the same position in X-axis direction and Y-axis direction. Further, the connecting end 12*a* and the connecting end 13*a* are electrically connected via a through hole electrode 18 embedded in a through hole 11*i* formed to the insulation board 11. That is, the inner conductor path 12 of a spiral form and the inner conductor path 13 of a spiral form 13 are electrically connected in series via the through hole 18.

When the inner conductor path 12 of a spiral form is viewed from the upper face 11*a* of the insulation board 11, the inner conductor path 12 forms a spiral in counterclockwise from the lead contact 12*b* at the outer end to the connecting end 12*a* at the inner end.

On the other hand, when the inner conductor path 13 is viewed from the upper face 11*a* of the insulation board 11, the inner conductor path 13 forms a spiral in counterclockwise from the connecting end 13*a* at the inner end to the lead contact 13*b* of the outer end.

Thereby, a direction of magnetic flux generated by electrical current flowing to the inner conductor paths 12 and 13 of a spiral form matches, and the magnetic flux of the inner conductor paths 12 and 13 of a spiral form is superimposed and becomes stronger, thus a larger inductance can be obtained.

The upper core 15 has a center projection part 15*a* of a circular column shape projecting down in Z-axis direction at a center part of a core main body of a rectangular flat board shape. Also, the upper core 15 has a side projection part 15*b* of a board shape projecting down in X-axis direction at both ends of Y-axis direction of the core main body of a rectangular flat board shape.

The lower core 16 is a rectangular flat board shape as similar to the core main body of the upper core 15, and the center projection part 15*a* and the side projection part 15*b* of the upper core 15 respectively connect with a center part and an end part in Y-axis direction of the lower core 16, thereby the lower core 16 and the upper core 15 are formed integrally.

Note that, in FIG. 2, the magnetic core 10 is shown by separating the upper core 15 and the lower core 16, but these may be integrally formed by a metal magnetic powder containing resin. Also, the center projection part 15*a* and/or the side projection part 15*b* formed to the upper core 15 may be formed to the lower core 16. In any case, the magnetic core 10 is constituted to have completely closed magnetic circuit, hence no gap exists in the closed magnetic circuit.

As shown in FIG. 2, a protective insulation layer 14 exists between the upper core 15 and the inner conductor path 12, and these are insulated. Also, a protective insulation layer 14 of a rectangular shape exists between the lower core 16 and the inner conductor path 13, and these are insulated. At the center part of the protective insulation layer 14, a through hole 14*a* of a circular shape is formed. Also, at the center part of the insulation board 11, a through hole 11*h* of a circular shape is formed. The center projection part 15*a* of the upper core 15 extends through these through holes 14*a* and 11*h* towards the lower core 16 and connects with the center part of the lower core 16.

Figure 4A:
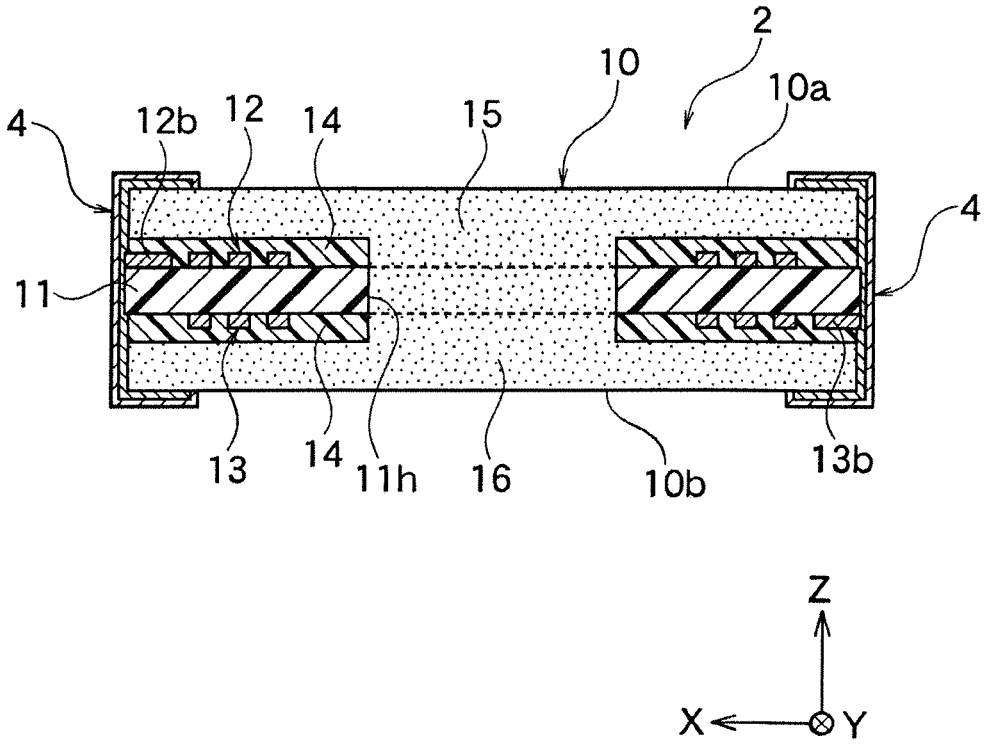
FIG. 4A is a cross section along IV-IV line shown in FIG. 1.
Figure 4B:
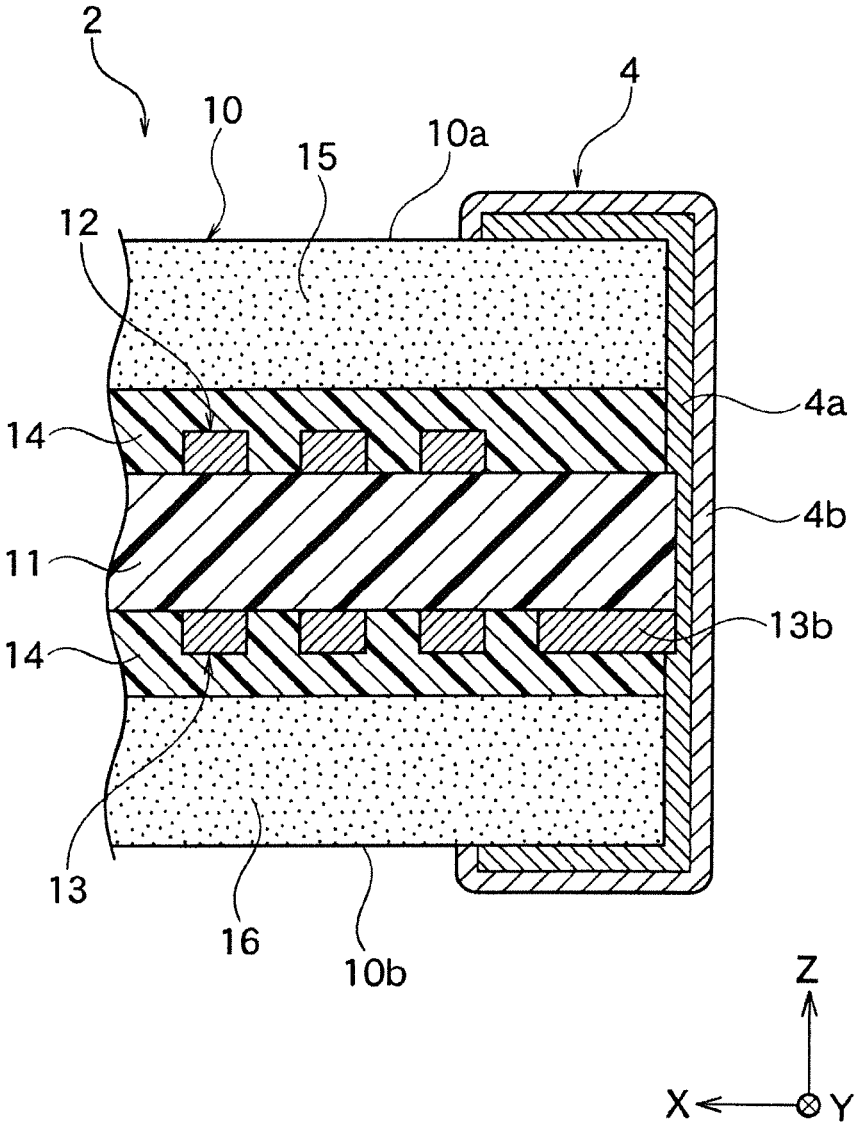
FIG. 4B is an enlarged cross section of an essential part near a terminal electrode of FIG. 4A.

As shown in FIG. 4A and FIG. 4B, in the present embodiment, the terminal electrode 4 has an inner layer 4*a* contacting with the X-axis direction end face of the magnetic core 10 and an outer layer 4*b* formed to the surface of the inner layer 4*a*. The inner layer 4*a* covers part of the upper face 10*a* and the lower face 10*b* of the magnetic core 10 near the end face in X-axis direction of the magnetic core 10; and the outer layer 4*b* covers the outer surface of the inner layer 4*a*.

Here, in the present embodiment, the magnetic core 10 is constituted by the metal magnetic powder containing resin. The metal magnetic powder containing resin is a magnetic material mixed with the metal magnetic powder in a resin.

Figure 6:
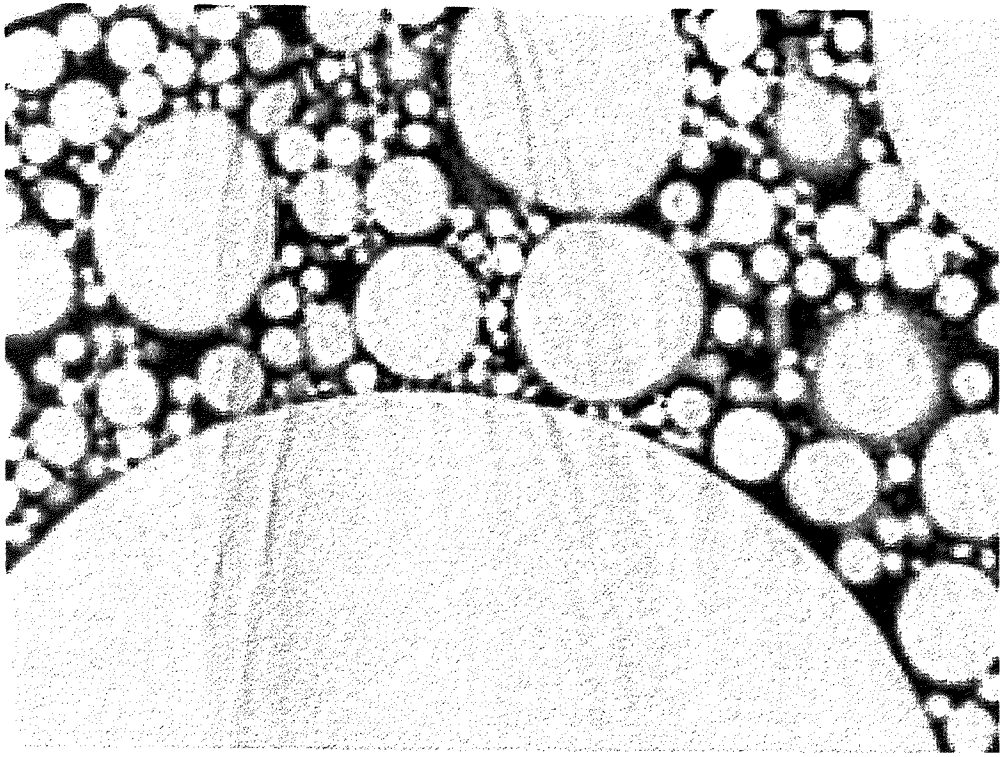
FIG. 6 is SEM image of a cross section of a magnetic core of Sample No. 10.

Here, in the present embodiment, when the magnetic core 10 is cut at an arbitrary cross section and the cross section is observed, the metal magnetic power having three different sizes which are large size powder, intermediate size powder, and small size powder is observed. In other words, the metal magnetic powder has the large size powder, the intermediate size powder, and the small size powder. Specifically, when the cross section of the magnetic core 10 is observed using SEM, it shows an embodiment indicated in FIG. 6. Note that, FIG. 6 is Sample No. 10 of the example described in below.

The particle size (circular equivalent diameter) of the large size powder is 10 μm or more and 60 μm or less; the particle size of the intermediate size powder is 2.0 μm or more and less than 10 μm; and the particle size of the small size powder is 0.1 μm or more and less than 2.0 μm.

Further, the large size powder includes a nano crystal. Here, the nano crystal is a crystal having a crystal particle size of nano order; and it is a crystal of 1 nm or more and 100 nm or less. Also, the nano crystal does not necessarily have to be included in all of the large size powder, but preferably 30% or more in terms of number of the large size powder includes the nano crystal.

Further, the intermediate size powder may include the nano crystal and 30% or more in terms of number of the intermediate size powder may include the nano crystal. By including the nano crystal in the intermediate size powder, the permeability further improves.

Note that, in the powder including the nano crystal, usually plurality of nano crystals is included in one particle of powder. That is, the particle size of the powder and the crystal particle size are different.

In the present embodiment, by including the nano crystal in the large size powder, the permeability of the magnetic core improves and the core loss decreases. Also, the DC superimposition property and the withstand voltage are suitably maintained without significantly decreasing.

Hereinafter, the nano crystal is described in further detail. Also, the compositions of the large size powder and the intermediate size powder is described.

The nano crystal of the present embodiment is preferably a Fe-based nano crystal. The Fe-based nano crystal has a particle size of nano order and a crystal structure of Fe is bcc (body centered cubic) structure.

In the present embodiment, the Fe-based nano crystal preferably has an average particle size of 5 to 30 nm. A soft magnetic alloy precipitated with such Fe-based nano crystal tends to have a high saturated magnetic flux and a coercivity tends to be low.

The composition of the Fe-based nano crystal in the present embodiment is not particularly limited. For example, M may be included besides Fe. Note that M is one or more element selected from the group consisting of Nb, Hf, Zr, Ta, Mo, W, and V.

The composition of the metal magnetic powder including the Fe-based nano crystal is not particularly limited. For example, it may be a soft magnetic alloy having a main component made of a compositional formula of $(Fe_{(1-(\alpha+\beta))}X1_{\alpha}X2_{\beta})_{(1-(a+b+c+d+e+f+g))}M_aB_bP_cSi_dC_eS_fTi_g$; in which X1 is one or more selected from the group consisting of Co and Ni, X2 is one or more selected from the group consisting of Al, Mn, Ag, Zn, Sn, As, Sb, Cu, Cr, Bi, N, 0, and rare earth elements, M is one or more selected from the group consisting of Nb, Hf, Zr, Ta, Mo, W, and V, and the main component satisfies the following $0.020 \leq a \leq 0.14$, $0.020 < b \leq 0.20$, $0 \leq c \leq 0.15$, $0 \leq d \leq 0.14$, $0 \leq e \leq 0.030$, $0 \leq f \leq 0.010$, $0 \leq g \leq 0.0010$, $\alpha \geq 0$, $\beta \geq 0$, and $0 \leq \alpha + \beta \leq 0.50$.

Hereinafter, each component of the metal magnetic powder including the Fe-nano crystal is described in detail.

M is one or more selected from the group consisting of Nb, Hf, Zr, Ta, Mo, W, and V.

A content (a) of M satisfies $0.020 \leq a \leq 0.14$. When "a" is small, a crystal having larger size than the nano crystal tends to be formed easily during the production of the metal magnetic powder. Also, a resistivity of the metal magnetic powder tends to decrease easily, the coercivity tends to increase easily, and the permeability tends to decrease easily. When "a" is large, a saturation magnetic flux density of the metal magnetic powder tends to decease easily.

A content (b) of B satisfies $0.020 < b \leq 0.20$. When "b" is small, a crystal having larger size than the nano crystal tends to be formed easily during the production of the metal magnetic powder. Also, the resistivity of the metal magnetic powder tends to decrease easily, the coercivity tends to increase easily, and the permeability tends to decrease easily. When "b" is large, the saturation magnetic flux density of the metal magnetic powder tends to decease easily.

A content (c) of P satisfies $0 \leq c \leq 0.15$. That is, P may not be included. When "c" is large, the saturation magnetic flux density of the metal magnetic flux tends to decease easily.

A content (d) of Si satisfies $0 \leq d \leq 0.14$. That is, Si may not be included. When "d" is too large, the coercivity of the metal magnetic powder tends to increase easily.

A content (e) of C satisfies $0 \leq e \leq 0.030$. That is, C may not be included. When "e" is large, the resistivity of the metal magnetic powder tends to decrease easily, the coercivity tends to increase easily.

A content (f) of S satisfies $0 \leq f \leq 0.010$. That is, S may not be included. When "f" is large, the coercivity tends to increase easily.

A content (g) of Ti satisfies $0 \leq g \leq 0.0010$. That is, Ti may not be included. When "g" is large, the coercivity tends to increase.

A content $(1-(a+b+c+d+e+f+g))$ of Fe is preferably $0.73 \leq (1-(a+b+c+d+e+f+g)) \leq 0.95$. By having $(1-(a+b+c+d+e+f+g))$ within the above range, the Fe-based nano crystal becomes easy to obtain.

Also, part of Fe may be substituted by X1 and/or X2.

X1 is one or more selected from the group consisting of Co and Ni. Regarding a content of X1, it may be $\alpha=0$. That is, X1 may not be included. Also, a number of X1 atoms in the entire composition is preferably 40 at % or less when a number of atoms of the entire composition is 100 at %. That is, $0 \leq \alpha\{1-(a+b+c+d+e+f+g)\} \leq 0.40$ is preferably satisfied.

X2 is one or more selected from the group consisting of Al, Mn, Ag, Zn, Sn, As, Sb, Cu, Cr, Bi, N, O, and rare earth elements. Regarding a content of X2, it may be $\beta=0$. That is, X2 may not be included. a number of X2 atoms in the entire composition is preferably 3.0 at % or less when a number of atoms of entire composition is 100 at %. That is, $0 \leq \beta\{1-(a+b+c+d+e+f+g)\} \leq 0.030$ is preferably satisfied.

In regards with a substitution amount of Fe which can be substituted by X1 and/or X2, it may be half or less of Fe in terms of a number of atoms. That is, it may be $0 \leq \alpha+\beta \leq 0.50$. When it is $\alpha+\beta > 0.50$, it becomes difficult to obtain the Fe-nano crystal.

Also, elements other than mentioned in above may be included within the range which does not significantly influence the properties. For example, these may be included in 0.1 wt % or less with respect to 100 wt % of the metal magnetic powder.

In the present embodiment, at an arbitrary cross section of the magnetic core 10, a ratio of the large size powder existing with respect to the metal magnetic powder is 39% or more and 91% or less in terms of an area ratio.

By making the ratio of the large size power existing in the metal magnetic powder to 39% or more in terms of an area ratio, the permeability of the magnetic core improves and the core loss decreases. Also, the DC superimposition property and the withstand voltage can be suitably maintained without decreasing.

Also, by making the ratio of the large size power existing in the metal magnetic powder to 91% or less in terms of an area ratio, the permeability of the magnetic core improves. Also, the DC superimposition property and the withstand voltage can be suitably maintained without decreasing. Further, the core loss can be suitably maintained without significantly increasing.

The ratio of the large size diameter existing with respect to the metal magnetic powder is preferably 59% or more and 86% or less, and more preferably 74% or more and 86% or less. Particularly, when the ratio of the large size powder existing in the metal magnetic powder is 74% or more and 86% or less, the core loss further decreases in case the intermediate size powder includes the nano-crystal.

In the present embodiment, at an arbitrary cross section of the magnetic core 10, a ratio of the intermediate size powder existing with respect to the ratio of the small size powder is preferably 0.73 or more and 5.7 or less in terms of an area ratio, and more preferably 0.73 or more and 2.3 or less. The smaller the ratio of the intermediate size powder existing with respect to the ratio of the small size powder is, the more suitable the permeability of the magnetic core is. On the other hand, the larger the ratio of the intermediate size powder existing with respect to the ratio of the small size powder is, the more suitable the DC superimposition property is.

In the present embodiment, the small size powder preferably includes permalloy and 30% or more of the small size powder in terms of a number of the small size powder may include permalloy. The permeability further improves by including permalloy in the small size powder.

Note that, all of the metal magnetic powder may include the nano crystal and when all of the metal magnetic powder includes the nano crystal, a content ratio of the metal magnetic powder of the magnetic core 10 tends to easily decrease and also the permeability tends to easily decrease.

Also, the nano crystal is expensive, therefore preferably the metal magnetic powder including the nano crystal and the metal magnetic powder which does not include the nano crystal are included at the same time. Specifically, a ratio of the metal magnetic powder including the nano crystal in terms of a weight ratio is preferably 40 wt % to 90 wt %.

Permalloy of the present embodiment is Ni-Fe based alloy and it is an alloy including 28 wt % or more of Ni and the rest made of Fe and other elements. A content of other elements is not particularly limited and it is 8 wt % or less when the Ni-Fe alloy is 100 wt %.

Note that, a content ratio of Ni in permalloy is preferably 40 to 85 wt %, and particularly preferably 75 to 82 wt %. An initial permeability improves and the core loss decreases by having the content ratio of Ni within the above mentioned range.

Figure 5:
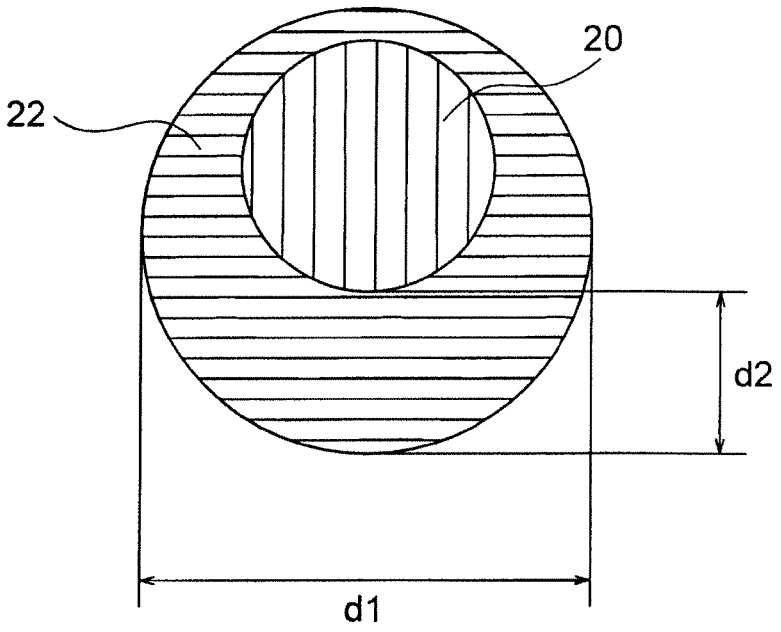
FIG. 5 is a schematic diagram of a metal magnetic powder which is insulation coated.

Also, the metal magnetic powder according to the present embodiment is preferably insulation coated as shown in FIG. 5. Even more preferably, each of the large size powder, the intermediate size powder, and the small size powder are insulation coated. By insulation coating the metal magnetic powder, the withstand voltage particularly improves. Note that, the powder is "insulation coated" means that among each powder, 50% or more of the powder is insulation coated.

A material of the insulation coating 22 is not particularly limited, and an insulation coating generally used in the present technical field can be used. A coating film including a glass made of $SiO_2$ or a phosphate chemical conversion coating including phosphate is preferably used. For the metal magnetic powder including permalloy, the coating film including a glass made of $SiO_2$ is particularly preferably used. Also, a method of carrying out an insulation coating is not particularly limited, and a method usually used in the present technical field can be used.

A thickness of the insulation coating 22 is not particularly limited. An average thickness of the insulation coating 22 of the metal magnetic powder is 5 to 45 nm and particularly preferably 10 to 35 nm.

The particle size of the metal magnetic powder of the insulation coated metal magnetic powder is a length d1 shown in FIG. 5. Also, a length d2 shown in FIG. 5 which is a maximum thickness of the insulation coating of the metal magnetic powder is a thickness of the insulation coating of the metal magnetic powder. Also, the insulation coating does not necessarily have to coat entire surface of the metal magnetic powder. When 50% or more of the surface of the metal magnetic powder is insulation coated, then it is considered as an insulation coated metal magnetic powder.

As the metal magnetic powder of the present embodiment has the above mentioned constitution, the magnetic core 10 having excellent initial permeability, core loss, DC superimposition property and withstand voltage can be obtained.

A content ratio of the metal magnetic powder in the metal magnetic powder containing resin is preferably 90 to 99 wt %, and more preferably 95 to 99 wt %. When the amount of the metal magnetic powder is decreased with respect to the resin, then the saturation magnetic flux density and the permeability decrease; and on the other hand, when the amount of the metal magnetic powder is increased, the saturation magnetic flux density and the permeability increase. Therefore, the saturation magnetic flux density and the permeability can be regulated by the amount of the metal magnetic powder.

The resin included in the metal magnetic powder containing resin functions as an insulation binder. As a material of the resin, liquid epoxy resin or powder epoxy resin is preferably used. Also, a content ratio of the resin is preferably 1 to 10 wt % and more preferably 1 to 5 wt %. Also, when the metal magnetic powder and the resin are mixed, preferably the metal magnetic powder containing resin solution is obtained using a resin solution. A solvent of the resin solution is not particularly limited.

Hereinafter, a method of producing the coil component 2 is described.

First, the inner conductor paths 12 and 13 having a spiral form are formed to the insulation board 11 by a plating method. A condition for plating is not particularly limited. Also, methods other than a plating method can be used.

Next, to both surfaces of the insulation board 11 formed with the inner conductor paths 12 and 13, the protective insulation layer 14 is formed. A method of forming the protective insulation layer 14 is not particularly limited. For example, the insulation board 11 is immersed in the resin solution diluted with a high boiling point solvent and then it is dried, thereby the protective insulation layer 14 can be formed.

Next, the magnetic core 10 made of the upper core 15 and the lower core 16 shown in FIG. 2 is formed. In order to do so, the above mentioned metal magnetic powder containing resin solution is coated on the surface of the insulation board 11 formed with the protective insulation layer 14. A method of coating is not particularly limited and generally it is coated by printing.

The metal magnetic powder of the present embodiment is produced by mixing a plurality of metal magnetic powders having a different particle size distribution. Here, by regulating the particle size distribution, a mixing ratio, and the like of the plurality of metal magnetic powders, the cross section area ratio of the large size powder, the intermediate size powder, and the small size powder of the magnetic core 10 obtained at the end can be regulated.

One example of relatively easily regulating the cross-section area ratio of the large size powder, the intermediate size powder, and the small size powder of the magnetic core 10 is described. In this method, a metal magnetic powder which will mainly become the large size powder, a metal magnetic powder which will mainly become the intermediate size powder, and a metal magnetic powder which will mainly become the small size powder in the magnetic core 10 obtained at the end are prepared separately. In this case, in order to sufficiently minimize a variation of the particle size of each metal magnetic powder, D50 of the metal magnetic powder which will mainly become the large size powder is set to 15 to 40 μm, D50 of the metal magnetic powder which will mainly become the intermediate size powder is set to 3.0 to 8.0 μm, and D50 of the metal magnetic powder which will mainly become the small size powder is set to 0.5 to 1.5 μm.

The large size powder, the intermediate size powder, and the small size powder are preferably spherical shape. In the present embodiment, a spherical shape refers to a case specifically having a spherical degree of 0.9 or more. Also, the spherical degree can be measured by a dynamic image analysis particle size analyzer.

Further, a method of producing the metal magnetic powder including the nano crystal (particularly the Fe-based nano crystal) is described. The method of producing the metal magnetic powder including the nano crystal (particularly the Fe-based nano crystal) is not particularly limited and from the point of easily making the metal magnetic powder including the nano crystal (particularly the Fe-based nano crystal) into a spherical shape, preferably it is produced by a gas atomization method.

In the gas atomization method, first, pure metal of each metal element included in the metal magnetic powder obtained at the end is prepared and weighed so that it satisfies the same composition as the metal magnetic powder obtained at the end. Then, the pure metal of each metal element is melted and mixed to produce a mother alloy. Note that, a method of melting the pure metal is not particularly limited and for example, a method of melting at high frequency heat at inside of a chamber after vacuuming the chamber may be mentioned. Note that, the mother alloy and a soft magnetic alloy obtained at the end have the same composition. Next, the produced mother alloy is heated and melted to obtain a molten metal (molten). A temperature of the molten metal is not particularly limited, and for example it can be 1200 to 1500° C.

Then, the molten is injected in the chamber thereby the metal magnetic powder is produced. The particle size distribution of the metal magnetic powder can be regulated by a method usually used in a gas atomization method. Here, preferably a gas injection temperature is 50 to 200° C. and a vapor pressure inside the chamber is 4 hPa or less. This is because the metal magnetic powder including the Fe-based nano crystal can be easily obtained by a heat treatment mentioned in below. At this point, the metal magnetic powder may only consist of amorphous or the metal magnetic powder may have a nanohetero structure. The nanohetero structure in the present embodiment refers to a structure wherein a nano crystal having a particle size of 30 nm or less exist in the amorphous.

Next, a heat treatment is carried out to the metal magnetic powder produced. When the metal magnetic powder is only consisted of amorphous, the heat treatment must be carried out; but if the metal magnetic powder has a nanohetero structure, then the heat treatment does not necessarily have to be carried out. This is because the metal magnetic powder already includes the nano crystal.

For example, by carrying out a heat treatment at 400 to 600° C. for 0.5 to 10 minutes, the metal magnetic powders sinter and prevent the powders from becoming large while promoting a diffusion of the elements. Further, it can be reached to thermodynamic equilibrium in short period of time thus strain and stress can be removed. As a result, the metal magnetic powder including the Fe-based nano crystal can be obtained easily. Note that, the metal magnetic powder including the Fe-based nano crystal after the heat treatment may or may not include amorphous.

Also, a method of calculating the average particle size of the Fe-based nano crystal included in the metal magnetic powder obtained by the heat treatment is not particularly limited. For example, it can be calculated by observing with a transmission electron microscope. Also, a method of verifying bcc (body centered cubic structure) of the crystal structure is not particularly limited. For example, it can be verified using X-ray diffraction measurement.

Next, a solvent portion of the metal magnetic powder containing resin solution coated by printing is evaporated to form the magnetic core 10.

Further, a density of the magnetic core 10 is improved. A method of improving the density of the magnetic core 10 is not particularly limited and for example, a method by press treatment may be mentioned.

Further, the upper face 11*a* and the lower face 11*b* of the magnetic core 10 are ground so that the magnetic core 10 has a predetermined thickness. Then, the resin is thermoset to cross link. A method of grinding is not particularly limited and for example, a method of using a fixed grinding stone may be mentioned. Also, the temperature and time for thermosetting is not particularly limited, and it may be regulated accordingly depending on a type of the resin and the like.

Then, the insulation board 11 formed with the magnetic core 10 is cut into dices. A method of cutting is not particularly limited, and for example a method of dicing may be mentioned.

According to the above method, the magnetic core 10 before the terminal electrode 4 shown in FIG. 1 is formed can be obtained. Note that, before cutting, the magnetic core 10 is integrally connected in X-axis direction and Y-axis direction.

Also, after cutting, the diced magnetic core 10 is subjected to an etching treatment. An etching condition is not particularly limited.

Next, an electrode material forming an inner layer 4*a* is prepared. A type of the electrode material is not particularly limited. For example, a conductive powder containing resin may be mentioned which contain a conductive powder such as Ag powder and the like in a thermosetting resin such as epoxy resin similar to the epoxy resin used for the above mentioned metal magnetic powder containing resin. In case of using the conductive powder containing resin as the electrode material, the electrode material is coated to both ends in X-axis direction of the magnetic core 10 carried out with the etching treatment and heated to cure the thermosetting resin, thereby the inner layer 4*a* is formed.

Next, the product formed with the inner layer 4*a* is carried out with a contact plating by barrel plating and the outer layer 4*b* is formed. The outer layer 4*b* may be a multilayer structure of 2 layers or more. A method for forming the outer layer 4*b* and the material of the outer layer 4*b* are not particularly limited and it may be formed for example by plating Ni on the inner layer 4*a*, then further plating Sn on Ni plating. The coil component 2 can be produced by the above mentioned method.

In the present embodiment, the magnetic core 10 is constituted by the metal magnetic powder containing resin thus a resin exists between the metal magnetic powders and fine gaps are formed; thereby the saturation magnetic flux density can be increased. Therefore, the magnetic saturation can be prevented without forming air gaps between the upper core 15 and the lower core 16. Therefore, there is no need to mechanically process the magnetic core with high precision to form gaps.

Further, the coil component 2 according to the present embodiment is formed as a collective body on the board surface, thereby the position of the coil is highly precise; and can be made more compact and thinner. Further, in the present embodiment, the metal magnetic material is used in the magnetic body and it has better DC superimposition property than ferrite, thus process to form magnetic gaps can be omitted.

Note that, the present invention is not to be limited to the above mentioned embodiment, and can be variously modified within the scope of the present invention. For example, even in case of embodiments other than a coil component shown in FIG. 1 to FIG. 4, a coil component having a coil covered by the above mentioned metal magnetic powder containing resin is the coil device of the present invention.

EXAMPLES

Hereinafter, the present invention is described based on the examples.

A toroidal core was produced to evaluate properties of a metal magnetic powder containing resin of a coil component according to the present invention. Hereinafter, a method of producing the toroidal core is described.

First, a large diameter powder 1, an intermediate size powder 1, and a small size powder 1 were prepared which were included in a metal magnetic powder in order to produce the metal magnetic powder included in the toroidal core.

First, nano crystal powders 1 to 3 having a composition (ratio of number of atoms) shown in Table 1 were prepared as the large size powder 1 and the intermediate size powder 1. Note that, in the composition shown in Table 1, in some cases the total may not be 100.0%, since the composition was rounded off to one decimal places.

TABLE 1

| | Fe (at %) | Cu (at %) | Nb (at %) | B (at %) | P (at %) | Si (at %) | C (at %) | S (at %) | Ti (at %) |
|---|---|---|---|---|---|---|---|---|---|
| Nano crystal alloy powder 1 | 79.9 | 0.1 | 7.0 | 10.0 | 3.0 | 0.0 | 0.0 | 0.1 | 0.0 |
| Nano crystal alloy powder 2 | 81.0 | 0.0 | 7.0 | 9.0 | 3.0 | 0.0 | 0.0 | 0.0 | 0.0 |
| Nano crystal alloy powder 3 | 72.9 | 1.0 | 3.1 | 9.1 | 0.0 | 14.0 | 0.0 | 0.0 | 0.0 |

A method of producing a nano crystal alloy powder used for the large size powder 1 and the intermediate size powder 1 is described.

First, a raw material metal was weighed so that it satisfied an alloy composition shown in Table 1. Then, it was melted by high frequency heating; thereby a mother alloy was produced.

Then, the produced mother alloy was heated and melted to form a metal in a melted state of 1250° C. Then, the metal was injected by a gas atomization method to form powder. A gas injection temperature was 150° C., a vapor pressure inside a chamber was 3.8 hPa. Also, the vapor pressure was adjusted by using Ar gas which was dew point adjusted. Also, a particle size distribution was regulated so that D50 was as shown in Tables 2 to 5.

Then, for each powder, a heat treatment was performed at 500° C. for 5 minutes to produce a nano crystal alloy powder.

In case of using amorphous powder as the large size powder 1, the Fe-based amorphous powder (made by Epson Atmix Corporation) having D50 of 24 μm was prepared. In case of using amorphous powder as the intermediate size powder, the Fe-based amorphous powder (made by Epson Atmix Corporation) having D50 of 3.0 μm was prepared. In below Tables 2 to 9, the Fe-based amorphous powder having D50 of 24 μm is listed as amorphous powder 1; and the Fe-based amorphous powder having D50 of 3.0 μm is listed as amorphous powder 2.

As the small size powder 1, pure iron powder and permalloy powder (Ni containing ratio of 78.5 wt %) were prepared.

Next, the above mentioned large size powder 1, the intermediate size powder 1, and the small size powder 1 (excluding pure iron powder) were carried out with coating.

The large size powder 1 and the intermediate size powder 1 were coated by forming a phosphate chemical conversion coating including phosphate (hereinafter, it may be simply referred as a phosphate chemical conversion coating). The phosphate chemical conversion coating was formed by spraying a solution including phosphate to the large size powder 1 and the intermediate size powder 1. Note that, an average thickness of the phosphate chemical conversion coating was 30 nm.

The small size powder 1 (excluding pure iron powder) was coated by forming an insulation coating made of glass including $SiO_2$ (hereinafter, it may be simply referred as glass coat). The glass coating was formed by spraying a solution including $SiO_2$ to the metal magnetic powder. Note that, an average thickness of the glass coating was 30 nm.

Further, the large size powder 1, the intermediate size powder 1, and the small size powder 1 were mixed so that a blending ratio in terms of a weight ratio satisfied as shown in Tables 2 to 5; thereby the metal magnetic powder was produced.

TABLE 2

| | Large size powder 1 (L1) | | Intermediate size powder 1 (M1) | | Small size powder 1 (Si) | | | Weight ratio |
|---|---|---|---|---|---|---|---|---|
| No. | Type | D50 (μm) | Type | D50 (μm) | Type | D50 (μm) | Coating | (L1/M1/S1) (wt%) |
| 3 | Nano crystal alloy powder 1 | 24 | Amorphous powder 2 | 3.0 | Pure iron powder | 1.0 | None | 40/30/30 |
| 4 | Nano crystal alloy powder 1 | 24 | Amorphous powder 2 | 3.0 | Pure iron powder | 1.0 | None | 60/20/20 |
| 4a | Nano crystal alloy powder 1 | 24 | Amorphous powder 2 | 3.0 | Pure iron powder | 1.0 | None | 75/12.5/12.5 |
| 5 | Nano crystal alloy powder 1 | 24 | Amorphous powder 2 | 3.0 | Pure iron powder | 1.0 | None | 80/10/10 |
| 6 | Nano crystal alloy powder 1 | 24 | Amorphous powder 2 | 3.0 | Pure iron powder | 1.0 | None | 85/7.5/7.5 |
| 6a | Nano crystal alloy powder 1 | 24 | Amorphous powder 2 | 3.0 | Pure iron powder | 1.0 | None | 90/5/5 |
| 8 | Nano crystal alloy powder 1 | 24 | Amorphous powder 2 | 3.0 | Permalloy powder | 0.7 | Coated | 40/30/30 |
| 9 | Nano crystal alloy powder 1 | 24 | Amorphous powder 2 | 3.0 | Permalloy powder | 0.7 | Coated | 60/20/20 |
| 10 | Nano crystal alloy powder 1 | 24 | Amorphous powder 2 | 3.0 | Permalloy powder | 0.7 | Coated | 80/10/10 |
| 11 | Nano crystal alloy powder 1 | 24 | Amorphous powder 2 | 3.0 | Permalloy powder | 0.7 | Coated | 85/7.5/7.5 |
| 13 | Nano crystal alloy powder 1 | 24 | Nano crystal alloy powder 1 | 3.0 | Permalloy powder | 0.7 | Coated | 40/30/30 |
| 14 | Nano crystal alloy powder 1 | 24 | Nano crystal alloy powder 1 | 3.0 | Permalloy powder | 0.7 | Coated | 60/20/20 |
| 15 | Nano crystal alloy powder 1 | 24 | Nano crystal alloy powder 1 | 3.0 | Permalloy powder | 0.7 | Coated | 80/10/10 |
| 16 | Nano crystal alloy powder 1 | 24 | Nano crystal alloy powder 1 | | Permalloy powder | 0.7 | Coated | 85/7.5/7.5 |

TABLE 3

| | Large size powder 1 (L1) | | Intermediate size powder 1 (M1) | | Small size powder 1 (S1) | | | Weight ratio |
|---|---|---|---|---|---|---|---|---|
| No. | Type | D50 (μm) | Type | D50 (μm) | Type | D50 (μm) | Coating | (L1/M1/S1) (wt%) |
| 18 | Nano crystal alloy powder 2 | 24 | Amorphous powder 2 | 3.0 | Permalloy powder | 0.7 | Coated | 40/30/30 |
| 19 | Nano crystal alloy powder 2 | 24 | Amorphous powder 2 | 3.0 | Permalloy powder | 0.7 | Coated | 60/20/20 |
| 20 | Nano crystal alloy powder 2 | 24 | Amorphous powder 2 | 3.0 | Permalloy powder | 0.7 | Coated | 80/10/10 |
| 21 | Nano crystal alloy powder 2 | 24 | Amorphous powder 2 | 3.0 | Permalloy powder | 0.7 | Coated | 85/7.5/7.5 |
| 23 | Nano crystal alloy powder 2 | 24 | Nano crystal alloy powder 2 | 3.0 | Permalloy powder | 0.7 | Coated | 40/30/30 |
| 24 | Nano crystal alloy powder 2 | 24 | Nano crystal alloy powder 2 | 3.0 | Permalloy powder | 0.7 | Coated | 60/20/20 |
| 25 | Nano crystal alloy powder 2 | 24 | Nano crystal alloy powder 2 | 3.0 | Permalloy powder | 0.7 | Coated | 80/10/10 |
| 26 | Nano crystal alloy powder 2 | 24 | Nano crystal alloy powder 2 | 3.0 | Permalloy powder | 0.7 | Coated | 85/7.5/7.5 |

TABLE 4

| | Large size powder 1 (LI) | | Intermediate size powder 1 (MI) | | Small size powder 1 (S1) | | | Weight ratio |
|---|---|---|---|---|---|---|---|---|
| No. | Type | D50 (μm) | Type | D50 (μm) | Type | D50 (μm) | Coating | (L1/M1/S1) (wt%) |
| 48 | Nano crystal alloy powder 3 | 24 | Amorphous powder 2 | 3.0 | Permalloy powder | 0.7 | Coated | 40/30/30 |
| 49 | Nano crystal alloy powder 3 | 24 | Amorphous powder 2 | 3.0 | Permalloy powder | 0.7 | Coated | 60/20/20 |
| 50 | Nano crystal alloy powder 3 | 24 | Amorphous powder 2 | 3.0 | Permalloy powder | 0.7 | Coated | 80/10/10 |
| 51 | Nano crystal alloy powder 3 | 24 | Amorphous powder 2 | 3.0 | Permalloy powder | 0.7 | Coated | 85/7.5/7.5 |
| 52 | Nano crystal alloy powder 3 | 24 | Amorphous powder 2 | 3.0 | Permalloy powder | 0.7 | Coated | 80/7/13 |
| 50 | Nano crystal alloy powder 3 | 24 | Amorphous powder 2 | 3.0 | Permalloy powder | 0.7 | Coated | 80/10/10 |
| 53 | Nano crystal alloy powder 3 | 24 | Amorphous powder 2 | 3.0 | Permalloy powder | 0.7 | Coated | 80/13/7 |
| 54 | Nano crystal alloy powder 3 | 24 | Amorphous powder 2 | 3.0 | Permalloy powder | 0.7 | Coated | 80/16/4 |
| 55 | Nano crystal alloy powder 3 | 24 | Amorphous powder 2 | 3.0 | Permalloy powder | 0.7 | Coated | 85/18/2 |

45

TABLE 5

| | Large size powder 1 (L1) | | Intermediate size powder 1 (M1) | | Small size powder 1 (S1) | | | Weight ratio |
|---|---|---|---|---|---|---|---|---|
| No. | Type | D50 (μm) | Type | D50 (μm) | Type | D50 (μm) | Coating | (L1/M1/S1) (wt%) |
| *1 | Amorphous powder 1 | 24 | Amorphous powder 2 | 3.0 | Pure iron powder | 1.0 | None | 80/10/10 |
| 5 | Nano crystal alloy powder 1 | 24 | Amorphous powder 2 | 3.0 | Pure iron powder | 1.0 | None | 80/10/10 |
| *7 | Amorphous powder 1 | 24 | Amorphous powder 2 | 3.0 | Permalloy powder | 0.7 | Coated | 80/10/10 |
| 10 | Nano crystal alloy powder 1 | 24 | Amorphous powder 2 | 3.0 | Permalloy powder | 0.7 | Coated | 80/10/10 |

TABLE 5-continued

| No. | Large size powder 1 (L1) Type | D50 (μm) | Intermediate size powder 1 (M1) Type | D50 (μm) | Small size powder 1 (S1) Type | D50 (μm) | Coating | Weight ratio (L1/M1/S1) (wt%) |
|---|---|---|---|---|---|---|---|---|
| *12 | Amorphous powder 1 | 24 | Nano crystal alloy powder 1 | 3.0 | Permalloy powder | 0.7 | Coated | 80/10/10 |
| 15 | Nano crystal alloy powder 1 | 24 | Nano crystal alloy powder 2 | 3.0 | Permalloy powder | 0.7 | Coated | 80/10/10 |
| 20 | Nano crystal alloy powder 2 | 24 | Amorphous powder 2 | 3.0 | Permalloy powder | 0.7 | Coated | 80/10/10 |
| 25 | Nano crystal alloy powder 2 | 24 | Nano crystal alloy powder 2 | 3.0 | Permalloy powder | 0.7 | Coated | 80/10/10 |
| 50 | Nano crystal alloy powder 3 | 24 | Amorphous powder 2 | 3.0 | Permalloy powder | 0.7 | Coated | 80/10/10 |

*is comparative example

Further, the metal magnetic powder containing resin was produced by kneading the metal magnetic powder with epoxy resin. A weight ratio of the metal magnetic powder formed with an insulation coating in the metal magnetic powder containing resin were 97.5 wt %. Note that, as the epoxy resin, phenol novolac type epoxy resin was used.

Further, the obtained metal magnetic powder containing resin was filled into a metal mold having a predetermined toroidal shape and it was heated at 100° C. for 5 hours to evaporate a solvent component. Then, a pressing treatment was performed at a pressure of 3 t/cm$^2$ and grinding was carried out using a fixed grinding stone so that a thickness was uniformly 0.7 mm. Then, the epoxy resin was cross-linked by thermosetting at 170° C. for 90 minutes, thereby a toroidal core (outer diameter of 15 mm, inner diameter of 9 mm, and thickness of 0.7 mm) was obtained.

Also, the obtained metal magnetic powder containing resin was filled into a metal mold having a predetermined rectangular parallelepiped shape. As similar to a method of forming the toroidal core, the magnetic material of rectangular parallelepiped shape (4 mm×4 mm×1 mm) was obtained. Further, at both ends of one surface having a size pf 4 mm×4 mm of the rectangular parallelepiped shape magnetic material, terminal electrodes having a width of 1.3 mm was provided. A distance between the terminal electrodes were 1.4 mm.

Next, a ratio of a large size powder 2, an intermediate size powder 2, and a small size powder 2 existing in the obtained toroidal core was measured.

The obtained toroidal core was cut at an arbitrary cross section, and the cross section was observed in an observation field of 0.128 mm×0.96 mm at a magnification of 1000× using SEM. Then, in the cross section, a powder having a particle size (circle equivalent diameter) of 10 μm or more and 60 μm or less was considered as the large size powder 2; a powder having a particle size of 2.0 μm or more and less than 10 μm was considered as the intermediate size powder 2; and a powder having a particle size of 0.1 μm or more and less than 2.0 μm was considered as the small size powder 2. Then, an area ratio (cross section area ratio) of the large size powder 2, the intermediate size powder 2, and the small size powder 2 at the cross section was verified. Note that, for calculating the area ratio, five different observation fields were identified and the area ratio of each powder in each observation field was calculated, then an average was calculated. Results are shown in Tables 6 to 9.

Also, regarding all samples shown in Tables 6 to 9, it was confirmed using SEM/EDS that at least 30% or more of the large size powder 2 in terms of number of the large size powder was derived from the large size powder 1. Also, it was confirmed that at least 30% or more of the intermediate size powder 2 was derived from the intermediate size powder 1; and at least 30% or more of the small size powder 2 was derived from the small size powder 1.

A coil was wound around the toroidal core, and various properties (initial permeability μi and core loss Pcv) were evaluated. Results are shown in Tables 6 to 9.

A coil was wound around for 30 windings, and an inductance (L0) at a frequency of 1 MHz was measured using a LCR meter, thereby the initial permeability μi was calculated from the inductance (L0). In the present examples, when μi was 30 or more, it was considered good; when μi was 35 or more, it was considered even better; when μi was 45 or more, it was considered particularly good; and when μi was 50 or more, it was considered excellent.

The coil was wound for 30 windings at a primary side and 30 windings at a secondary side, and the core loss Pcv was measured at a magnetic flux density of 10 mT and a frequency of 3 MHz using an AC-BH analyzer. In the present examples, when the core loss was 650 kW/m$^3$ or less, it was considered good; when the core loss was 600 kW/m$^3$, it was considered even better; when the core loss was 550 kW/m$^3$, it was considered particularly good; and when the core loss was 500 kW/m$^3$, it was considered excellent.

Further, the DC superimposition property was measured. First, an inductance (L0) was measured while DC current was not applied. Next, an inductance (L1) was measured while DC current was applied. The level of DC current when 100×(L0−L1)/L0 (%) was 90% was defined as Idc1 (A). In the present examples, when Idc1 was 3.5 A or more, the DC superimposition property was considered good; when Idc1 was 4.5 A or more, it was considered good; and when Idc1 was 5.5 A or more, it was considered excellent.

Further, voltage was applied to the terminal electrodes of the rectangular parallelepiped shape, and the voltage was measured when 2 mA current flew, thereby an insulation breakdown intensity was measured. In the present examples, a withstand voltage of 200 V or more was considered good, 700 V or more was considered further better, 750 V or more was considered even better, 800 V or more was considered even more better, and 900 V or more was considered excellent.

TABLE 6

| No. | Large size powder 2 (L2) Main type | Intermediate size powder 2 (M2) Main type | Small size powder 2 (S2) Main type | Cross section area ratio (L2/M2/S2) (%) | M2/S2 | μi | Pcv (kW/m3) | Idol (A) | Withstand voltage (V) |
|---|---|---|---|---|---|---|---|---|---|
| 3 | Nano crystal alloy powder 1 | Amorphous powder 2 | Pure iron powder | 39/33/29 | 1.1 | 40 | 623 | 6.0 | 335 |
| 4 | Nano crystal alloy powder 1 | Amorphous powder 2 | Pure iron powder | 59/22/19 | 1.2 | 40 | 556 | 6.0 | 280 |
| 4a | Nano crystal alloy powder 1 | Amorphous powder 2 | Pure iron powder | 74/13.5/11.5 | 1.2 | 44 | 495 | 5.5 | 285 |
| 5 | Nano crystal alloy powder 1 | Amorphous powder 2 | Pure iron powder | 79/11/10 | 1.1 | 45 | 500 | 5.5 | 230 |
| 6 | Nano crystal alloy powder 1 | Amorphous powder 2 | Pure iron powder | 85/8/7 | 1.1 | 43 | 486 | 5.7 | 215 |
| 6a | Nano crystal alloy powder 1 | Amorphous powder 2 | Pure iron powder | 91/6/4 | 1.5 | 41 | 479 | 5.8 | 200 |
| 8 | Nano crystal alloy powder 1 | Amorphous powder 2 | Permalloy powder | 40/33/27 | 1.2 | 45 | 546 | 4.5 | 930 |
| 9 | Nano crystal alloy powder 1 | Amorphous powder 2 | Permalloy powder | 60/22/18 | 1.2 | 45 | 503 | 4.5 | 830 |
| 10 | Nano crystal alloy powder 1 | Amorphous powder 2 | Permalloy powder | 80/11/9 | 1.2 | 50 | 494 | 4.3 | 750 |
| 11 | Nano crystal alloy powder 1 | Amorphous powder 2 | Permalloy powder | 85/8/7 | 1.1 | 48 | 482 | 4.4 | 730 |
| 13 | Nano crystal alloy powder 1 | Nano crystal alloy powder 1 | Permalloy powder | 41/31/28 | 1.1 | 48 | 559 | 4.3 | 925 |
| 14 | Nano crystal alloy powder 1 | Nano crystal alloy powder 1 | Permalloy powder | 61/20/19 | 1.1 | 49 | 543 | 4.3 | 830 |
| 15 | Nano crystal alloy powder 1 | Nano crystal alloy powder 1 | Permalloy powder | 81/10/9 | 1.1 | 53 | 450 | 4.1 | 750 |
| 16 | Nano crystal alloy powder 1 | Nano crystal alloy powder 1 | Permalloy powder | 86/8/7 | 1.1 | 51 | 424 | 4.2 | 730 |

TABLE 7

| No. | Large size powder 2 (L2) Main type | Intermediate size powder 2 (M2) Main type | Small size powder 2 (S2) Main type | Cross section area ratio (L2/M2/S2) (%) | M2/S2 | μi | Pcv (kW/m3) | Idc1 (A) | Withstand voltage (V) |
|---|---|---|---|---|---|---|---|---|---|
| 18 | Nano crystal alloy powder 2 | Amorphous powder 2 | Permalloy powder | 40/33/27 | 1.2 | 48 | 501 | 4.7 | 930 |
| 19 | Nano crystal alloy powder 2 | Amorphous powder 2 | Permalloy powder | 60/22/18 | 1.2 | 49 | 499 | 4.7 | 830 |
| 20 | Nano crystal alloy powder 2 | Amorphous powder 2 | Permalloy powder | 80/11/9 | 1.2 | 52 | 491 | 4.5 | 760 |
| 21 | Nano crystal alloy powder 2 | Amorphous powder 2 | Permalloy powder | 85/8/7 | 1.1 | 51 | 476 | 4.6 | 735 |
| 23 | Nano crystal alloy powder 2 | Nano crystal alloy powder 2 | Permalloy powder | 41/31/28 | 1.1 | 49 | 541 | 4.5 | 925 |
| 24 | Nano crystal alloy powder 2 | Nano crystal alloy powder 2 | Permalloy powder | 61/20/18 | 1.1 | 51 | 521 | 4.5 | 830 |
| 25 | Nano crystal alloy powder 2 | Nano crystal alloy powder 2 | Permalloy powder | 81/10/9 | 1.1 | 54 | 440 | 4.3 | 750 |
| 26 | Nano crystal alloy powder 2 | Nano crystal alloy powder 2 | Permalloy powder | 86/8/7 | 1.1 | 51 | 423 | 4.4 | 735 |

TABLE 8

| No. | Large size powder 2 (L2) Main type | Intermediate size powder 2 (M2) Main type | Small size powder 2 (S2) Main type | Cross section area ratio (L2/M2/52) (%) | M2/S2 | μi | Pcv (kW/m3) | Idc1 (A) | Withstand voltage (V) |
|---|---|---|---|---|---|---|---|---|---|
| 48 | Nano crystal alloy powder 3 | Amorphous powder 2 | Permalloy powder | 41/33/26 | 1.3 | 43 | 554 | 4.3 | 925 |
| 49 | Nano crystal alloy powder 3 | Amorphous powder 2 | Permalloy powder | 61/22/17 | 1.3 | 45 | 503 | 4.1 | 820 |
| 50 | Nano crystal alloy powder 3 | Amorphous powder 2 | Permalloy powder | 81/11/9 | 1.2 | 48 | 521 | 3.9 | 760 |

TABLE 8-continued

| No. | Large size powder 2 (L2) Main type | Intermediate size powder 2 (M2) Main type | Small size powder 2 (S2) Main type | Cross section area ratio (L2/M2/52) (%) | M2/S2 | μi | Pcv (kW/m3) | Idc1 (A) | Withstand voltage (V) |
|---|---|---|---|---|---|---|---|---|---|
| 51 | Nano crystal alloy powder 3 | Amorphous powder 2 | Permalloy powder | 86/8/6 | 1.3 | 46 | 511 | 4.1 | 740 |
| 52 | Nano crystal alloy powder 3 | Amorphous powder 2 | Permalloy powder | 81/8/11 | 0.73 | 45 | 515 | 4.2 | 750 |
| 50 | Nano crystal alloy powder 3 | Amorphous powder 2 | Permalloy powder | 81/11/9 | 1.2 | 48 | 521 | 3.9 | 760 |
| 53 | Nano crystal alloy powder 3 | Amorphous powder 2 | Permalloy powder | 80/14/6 | 2.3 | 45 | 517 | 4.3 | 760 |
| 54 | Nano crystal alloy powder 3 | Amorphous powder 2 | Permalloy powder | 80/17/3 | 5.7 | 38 | 521 | 4.7 | 755 |
| 55 | Nano crystal alloy powder 3 | Amorphous powder 2 | Permalloy powder | 79/19/2 | 9.5 | 32 | 514 | 5.7 | 760 |

TABLE 9

| No. | Large size powder 2 (L2) Main type | Intermediate size powder 2 (M2) Main type | Small size powder 2 (S2) Main type | Cross section area ratio (L2/M2/52) (%) | μi | Pcv (kW/m3) | Idc1 (A) | Withstand voltage (V) |
|---|---|---|---|---|---|---|---|---|
| *1 | Amorphous powder 1 | Amorphous powder 2 | Pure iron powder | 81/10/9 | 39 | 980 | 6.7 | 230 |
| 5 | Nano crystal alloy powder 1 | Amorphous powder 2 | Pure iron powder | 79/11/10 | 45 | 500 | 5.5 | 230 |
| *7 | Amorphous powder 1 | Amorphous powder 2 | Permalloy powder | 81/10/9 | 44 | 980 | 5.6 | 740 |
| 10 | Nano crystal alloy powder 1 | Amorphous powder 2 | Permalloy powder | 80/11/9 | 50 | 494 | 4.3 | 750 |
| *12 | Amorphous powder 1 | Nano crystal alloy powder 1 | Permalloy powder | 80/11/9 | 43 | 950 | 5.8 | 750 |
| 15 | Nano crystal alloy powder 1 | Nano crystal alloy powder 1 | Permalloy powder | 81/10/9 | 53 | 450 | 4.1 | 750 |
| 20 | Nano crystal alloy powder 2 | Amorphous powder 2 | Permalloy powder | 80/11/9 | 52 | 491 | 4.5 | 760 |
| 25 | Nano crystal alloy powder 2 | Nano crystal alloy powder 2 | Permalloy powder | 81/10/9 | 54 | 440 | 4.3 | 750 |
| 50 | Nano crystal alloy powder 3 | Amorphous powder 2 | Permalloy powder | 81/11/9 | 48 | 521 | 3.9 | 760 |

*is comparative example

Sample No. 3 to 6 and 6a shown in Table 6 are examples when the large size powder 2 was mainly nano crystal alloy powder 1, the intermediate size powder 2 was mainly amorphous powder 2, and the small size powder was mainly pure iron powder; and also, a blending ratio of powders was varied.

Sample No. 3 to 6 and 6a of which the cross section area ratio (L2) of the large size powder 2 with respect o the metal magnetic powder was 39% ore more and 91% or less had good initial permeability μi, core loss Pcv, DC superimposition property, and withstand voltage.

Sample No. 8 to 11 shown in Table 6 are examples when the large size powder 2 was mainly nano crystal alloy powder 1, the intermediate size powder 2 was mainly amorphous powder 2, and the small size powder 2 was mainly permalloy powder; and also a blending ratio of powders was varied. Sample No. 13 to 16 shown in Table 6 are examples when the large size powder 2 was mainly nano crystal alloy powder 1, the intermediate size powder 2 was mainly nano crystal alloy powder 1, and the small size powder 2 was mainly permalloy powder; and also a blending ratio of powders was varied.

Sample No. 8 to 11 and 13 to 16 having the cross section area ratio (L2) of the large size powder 2 with respect to the metal magnetic powder of 39% or more and 91% or less and the small size powder 2 including permalloy had good initial permeability μi, core loss Pcv, DC superimposition property, and withstand voltage. Particularly, the withstand voltage was good compared to the case in which the small size powder 2 was pure iron powder.

Sample No. 18 to 21 shown in Table 7 are examples when the large size powder 2 was mainly nano crystal alloy powder 2, the intermediate size powder 2 was mainly amorphous powder 2, and the small size powder 2 was mainly permalloy; and also a blending ratio of powders was varied. Sample No. 23 to 26 shown in Table 7 are examples when the large size powder 2 was mainly nano crystal alloy powder 2, the intermediate size powder 2 was mainly nano crystal alloy powder 2, and the small size powder 2 was mainly permalloy and a blending ratio of powders was varied.

Sample No. 18 to 21 and 23 to 26 having the cross section area ratio (L2) of the large size powder 2 with respect to the metal magnetic powder of 39% or more and 91% or less and the small size powder 2 including permalloy had good initial permeability μi, core loss Pcv, DC superimposition property, and withstand voltage.

Sample No. 48 to 51 shown in Table 8 are examples when the large size powder 2 was mainly nano crystal alloy powder 3, the intermediate size powder 2 was mainly amorphous powder 2, and the small size powder 2 was mainly permalloy; and also a blending ratio of powders was varied.

Sample No. 48 to 51 having the cross section area ratio (L2) of the large size powder 2 with respect to the metal magnetic powder of 39% or more and 91% or less and the small size powder 2 including permalloy had good initial permeability μi, core loss Pcv, DC superimposition property, and withstand voltage.

Sample No. 52 to 55 are examples in which a blending ratio of the intermediate size powder and the small size powder was changed from Sample No. 50.

Sample No. 52 to 55 having the cross section area ratio (L2) of the large size powder 2 with respect to the metal magnetic powder of 39% or more and 91% or less and the small size powder 2 including permalloy had good initial permeability μi, core loss Pcv, DC superimposition property, and withstand voltage. Also, as the cross section area ratio of the intermediate size powder 2 increased, DC superimposition property tended to improve but the initial permeability μi tended to decrease.

Table 9 shows results of certain samples among the samples shown in Tables 6 to 8 of which the cross section area ratio of the large size powder 2 was about 80% and the cross section area ratios of the intermediate size powder 2 and the small size powder 2 were about 10% respectively. Also, Table 9 shows Sample No. 1, 7, and 12 of which the large size powder 1 was mainly amorphous powder 1. Note that, particularly regarding Sample No. 12, it was confirmed that the nano crystal was not observed in the large size powder 2 using STEM.

Samples having the cross section area ratio (L2) of the large size powder 2 with respect to the metal magnetic powder of 39% or more and 91% or less and the large size diameter including nano crystal had good initial permeability μi, core loss Pcv, DC superimposition property, and withstand voltage.

On the other hand, Sample No. 1, 7, and 12 in which the large size powder 2 did not include the nano crystal, a core loss Pcv was significantly large.

Also, when the large size powder 2 was mainly nano crystal alloy powder 1 and/or nano crystal alloy powder 2, the initial permeability μi, the core loss Pcv, and the DC superimposition property were particularly good compared to the case when the large size powder 2 was mainly nano crystal alloy powder 3.

Also, the case in which the intermediate size powder 2 was mainly amorphous powder and the case in which the intermediate size powder 2 was mainly nano crystal alloy powder are compared. When the intermediate size powder 2 was mainly amorphous powder, the DC superimposition property was good. On the other hand, when the intermediate size powder 2 was mainly nano crystal alloy powder, the initial permeability μi and the core loss Pcv were good.

Experiment 2

The magnetic core shown in FIG. 1 to FIG. 4A and FIG. 4B was produced using the metal magnetic powder containing resin used in above mentioned examples, then the coil component shown in FIG. 1 to FIG. 4A and FIG. 4B was produced. The coil component using the metal magnetic powder containing resin used in examples had good initial permeability, core loss, and DC superimposition property. Further, when the small size powder 2 was mainly permalloy powder, a coil component having a good withstand voltage can be obtained.

NUMERICAL REFERENCES

2 . . . Coil component
4 . . . Terminal electrode
4*a* . . . Inner layer
4*b* . . . Outer layer
10 . . . Magnetic core
11 . . . Insulation board
12,13 . . . Internal conductor path
12*a*,13*a* . . . Connecting end
12*b*,13*b* . . . Lead contact
14 . . . Protective insulation layer
15 . . . Upper core
15*a* . . . Center projection part
15*b* . . . Side projection part
16 . . . Lower core
18 . . . Through hole conductor
20 . . . Metal magnetic powder being insulation coated
22 . . . Insulation coating

What is claimed is:

1. A magnetic core comprising a metal magnetic powder, in which the metal magnetic powder includes a large size powder, an intermediate size powder, and a small size powder, a particle size of the large size powder is 10 μm or more and 60 μm or less, a particle size of the intermediate size powder is 2.0 μm or more and less than 10 μm, a particle size of the small size powder is 0.1 μm or more and less than 2.0 μm, the large size powder includes a nano crystal, a ratio of the large size powder existing with respect to the metal magnetic powder is 39% or more and 91% or less in terms of an area ratio in a cross section of the magnetic core and a ratio of the intermediate size powder existing with respect to a ratio of the small size powder is 0.73 or more and 5.7 or less, each ratio being in terms of an area ratio in a cross section of the magnetic core.

2. The magnetic core according to claim 1, wherein the intermediate size powder includes a nano crystal.

3. The magnetic core according to claim 1, wherein the small size powder includes a permalloy.

4. The magnetic core according to claim 1, wherein the nano crystal is a Fe-based nano crystal.

5. The magnetic core according to claim 4, wherein the Fe-based nano crystal includes Fe and M, and M is one or more selected from the group consisting of Nb, Hf, Zr, Ta, Mo, W, and V.

6. The magnetic core according to claim 1, wherein the metal magnetic powder has an insulation coating.

7. The magnetic core according to claim 6, wherein an average thickness of the insulation coating is 5 to 45 nm.

8. The magnetic core according to claim 1, wherein a ratio of the metal magnetic powder including the nano crystal with respect to entire magnetic metal powder is 40 wt % to 90 wt % in terms of a weight ratio.

9. A coil component having the magnetic core according to claim 1 and a coil.

10. The magnetic core according to claim 1, wherein the ratio of the large size powder existing with respect to the metal magnetic powder is 59% or more and 86% or less in terms of an area ratio in a cross section of the magnetic core.

11. The magnetic core according to claim 1, wherein the ratio of the large size powder existing with respect to the metal magnetic powder is 74% or more and 86% or less in terms of an area ratio in a cross section of the magnetic core.

12. The magnetic core according to claim 1, wherein a ratio of the intermediate size powder existing with respect to a ratio of the small size powder is 0.73 or more and 2.3 or less, each ratio being in terms of an area ratio in a cross section of the magnetic core.

* * * * *